United States Patent [19]

Henzel et al.

[11] Patent Number: 4,829,050

[45] Date of Patent: May 9, 1989

[54] SOLID PARTICLE LUBRICANTS FOR SLIPPING LAYER OF DYE-DONOR ELEMENT USED IN THERMAL DYE TRANSFER

[75] Inventors: Richard P. Henzel, Webster; Noel R. Vanier, Rochester, both of N.Y.

[73] Assignee: Eastman Kodak Company, Rochester, N.Y.

[21] Appl. No.: 184,316

[22] Filed: Apr. 21, 1988

Related U.S. Application Data

[63] Continuation-in-part of Ser. No. 62,797, Jun. 16, 1987, abandoned.

[51] Int. Cl.[4] ..... B41M 5/035; B41M 5/26

[52] U.S. Cl. ..... 503/227; 8/471; 428/195; 428/480; 428/913; 428/914

[58] Field of Search ..... 8/471; 428/913, 195, 428/480, 914; 503/227

[56] References Cited

U.S. PATENT DOCUMENTS 4,572,860 2/1986 Nakamura et al. ..... 8/471

FOREIGN PATENT DOCUMENTS 138483 4/1985 European Pat. Off. ..... 503/227
60-192630 10/1985 Japan ..... 503/227
62-121093 6/1987 Japan ..... 503/227

*Primary Examiner*—Bruce H. Hess
*Attorney, Agent, or Firm*—Harold E. Cole

[57] ABSTRACT

A dye-donor element for thermal dye transfer comprising a support having on one side thereof a dye layer and on the other side a slipping layer comprising a lubricating material dispersed in a water-insoluble, cellulosic binder, the lubricating material comprising dry, solid lubricant particles protruding from the surface of the slipping layer, such as poly(tetrafluoroethylene), poly(-hexafluoropropylene) or poly(methylsilylsesquioxane).

20 Claims, No Drawings

SOLID PARTICLE LUBRICANTS FOR SLIPPING LAYER OF DYE-DONOR ELEMENT USED IN THERMAL DYE TRANSFER

This invention relates to dye-donor elements used in thermal dye transfer, and more particularly to the use of a certain slipping layer on the back side thereof to prevent various printing defects and tearing of the donor element during the printing operation.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method for Controlling A Thermal Printer Apparatus," issued Nov. 4, 1986, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing head. This causes intermittent rather than continuous transport across the thermal head. The dye transferred thus does not appear as a uniform area, but rather as a series of alternating light and dark bands (chatter marks). Another defect called "smiles", which are crescent shaped low density areas, is produced in the receiving element by stretch-induced folds in the dye-donor. Another defect is produced in the receiving element when abraded or melted debris from the back of the dye-donor builds up on the thermal head and causes steaks parallel to the travel direction and extending over the entire image area. In extreme cases, sufficient friction is often created to tear the dye-donor element during printing. It would be desirable to eliminate such problems in order to have a commercially acceptable system.

European Patent Application No. 138,483 relates to dye-donor elements having a slipping layer on the back side thereof comprising a lubricant in a resin binder along with particulate material. A large list of lubricating materials is disclosed including surface active agents, liquid lubricants and mixtures thereof with or without further addition of solid lubricants. Included in the list of useful solid lubricants is tetrafluoroethylene resin. However, it was found that a surface active agent in such a slipping layer caused a problem of unwanted dye transfer from the front of the donor to the back side when the donor is rolled up on itself, as will be shown by a comparative test hereinafter. In addition, the slipping layer in that publication has a rough surface due to the presence of non-lubricating particulate material in order to prevent the dye-donor sheet from sticking to the thermal printing head. Such particulate material could have an abrading effect on the printing head, however, and is undesirable for that reason. Further, the binder in that slipping layer is not a water-insoluble cellulosic binder as in the instant invention.

In JP No. 62/121,093, there is a disclosure of a dye-donor element having a slipping layer comprising microparticles and a certain polymeric binder. The polymeric binder, however, is a very specific terpolymer containing a quaternary ammonium salt and long chain alkyl groups.

In JP No. 60/192,630, there is a disclosure of a dye-donor element having a slipping layer comprising an aqueous polymeric coating of poly(tetrafluoroethylene) particles. There is a problem with these aqueous coatings, however, in that they have printing defects as described above. It would be desirable to provide a polymeric binder for such particles which does not have these printing defects; this will be shown by the comparative tests hereinafter. In addition, an aqueous coating would require a different coating machine from the solvent coating machine used for the other layers.

These and other objects are achieved in accordance with this invention which relates to a dye-donor element for thermal dye transfer comprising a support having on one side thereof a dye layer and on the other side a slipping layer comprising a lubricating material dispersed in a water-insoluble, cellulosic binder, the lubricating material comprising dry, solid lubricant particles protruding from the surface of the slipping layer.

Any amount of lubricant particles can be employed in the slipping layer of the invention as long as the desired effect is obtained. In general, the ratio of binder to lubricant is from about 0.1 to about 10. In a preferred embodiment of the invention, the lubricant has a particle size below about 10 $\mu$m.

Any dry, solid lubricant particles can be employed in the invention as long as they have the desired properties. In a preferred embodiment, the lubricant particles are poly(tetrafluoroethylene), poly(hexafluoropropylene) or poly(methylsilylsesquioxane).

As noted above, the polymeric binder of the slipping layer of the invention is a water-insoluble, cellulosic binder. Such materials include, for example, cellulose nitrate, cellulose acetate propionate, cellulose acetate butyrate, etc. In a preferred embodiment of the invention, the cellulosic binder also contains a polyvinyl acetal, such as, for example, poly(vinyl alcohol-co-butyral), poly(vinyl alcohol-co-acetal), etc. In another preferred embodiment, the polyvinyl acetal is a terpolymer of polyvinyl butyral, polyvinyl alcohol and polyvinyl acetate. This material is sold commercially as Butvar 76® by Monsanto.

In another preferred embodiment of the invention, the lubricant material is poly(tetrafluoroethylene) dispersed in a cellulose nitrate binder.

The amount of polymeric binder used in the slipping layer of the invention is not critical. In general, the polymeric binder may be present in an amount of from about 0.05 to about 2 g/m$^2$.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Mitkazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

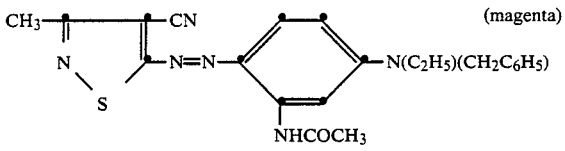

(magenta)

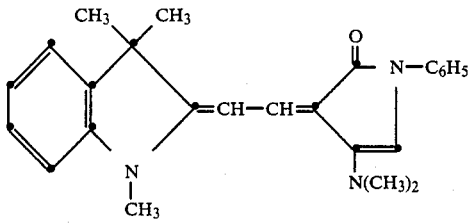

(yellow)

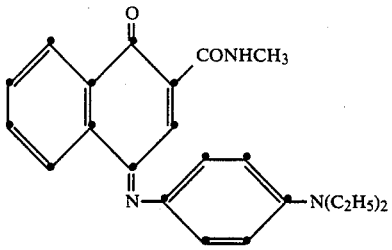

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207 of Vanier and Lum; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-door element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 2 to about 30 μm. It may also be coated with a subbing layer, if desired, such as those materials described in U.S. Pat. No. 4,695,288 of Ducharme or U.S. patent application Ser. No. 079,613 of Henzel, filed July 30, 1987.

The dye-receiving element that is used with the dye-donor element of the invention usually comprises a support having thereon a dye image-receiving layer. The support may be a transparent film such as a poly(ether sulfone), a polyamide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek ®.

The dye image-receiving layer may comprise, for example, a polycarbonate, a polyurethane, a polyester, polyvinyl chloride, a poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651 of Moore, Weaver and Lum; 4,695,287 of Evans and Lum; and 4,701,439 of Weaver, Moore and Lum; and U.S. patent application Ser. Nos. 059,442 of Byers and Chapman, filed June 8, 1987; 059,443 of Evans and Weber, filed June 8, 1987; 095,796 of Evans and Weber, filed Sept. 14, 1987; and 123,441 of Byers, Chapman and McManus, filed Nov. 20, 1987, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

A dye-receiving element was prepared by coating 3.8 g/m$^2$ of Makrolon 5705® polycarbonate resin (Bayer A.G.), 1,4-didecoxy-2,5-dimethoxybenzene (0.32 g/m$^2$) and FC-431® (3M Corp.) surfactant (0.016 g/m$^2$) using a solvent mixture of methylene chloride and trichloroethylene on a titanium dioxide-containing 175 μm poly(ethylene terephthalate) support.

A cyan dye-donor element was prepared by coating on a 6 μm poly(ethylene terephthalate) support:

(1) a subbing layer of a titanium alkoxide (duPont Tyzor TBT®) (0.081 g/m$^2$) from a n-propyl acetate and n-butyl alcohol solvent mixture, and (2) a dye layer containing the cyan dye illustrated above (0.28 g/m$^2$) and duPont DLX-6000 Teflon® micropowder (0.016 g/m$^2$) in a cellulose acetate propionate (2.5% acetyl, 45% propionyl) binder (0.44 g/m$^2$) coated from a toluene, methanol and cyclopentanone solvent mixture. On the back side of the dye-donor was coated:

(1) a subbing layer of Bostik 7650® polyester (Emhart Corp.) (0.11 g/m$^2$) coated from a toluene and 3-pentanone solvent mixture, and (2) a slipping layer of the materials identified below in the amounts specified in Table 1 coated from a toluene and 3-pentanone solvent mixture.

Particulate lubricant 1

Emralon 329® (Acheson Colloids Co., Port Huron, Mich. 48060) described by the manufacturer as a dry-film lubricant of poly(tetrafluoroethylene) particles in a thermoplastic resin supplied as a liquid concentrate. The thermoplastic resin is cellulose nitrate in a propyl acetate, toluene, isopropyl alcohol and 2-butanol solvent. The approximate particle size of the irregular shaped particles is from 1 to 5 μm.

Particulate lubricant 2

DLX-6000® (duPont Corp.) poly(tetrafluoroethylene) micropowder. These Teflon® beads are approximately 1 μm diameter. Suitable polymeric binders for this material include cellulose nitrate, cellulose acetate propionate (2.0–2.8% acetyl, 40–46% propionyl) and cellulose acetate butyrate (2.0% acetyl, 47% butyryl).

Particulate lubricant 3

Fluo-HT® (MicroPowder Inc.) fluorocarbon powder of micronized polytetrafluoroethylene of 2 μm average particle size. A suitable binder for this material is cellulose nitrate using a coating solvent mixture of toluene and 3-pentanone.

Particulate lubricant 4

Whitcon TL-102C® (LNP Corp.) fluorocarbon powder of polytetrafluoroethylene of 2–4 μm particle size. A suitable binder for this material is cellulose acetate propionate (2.5% acetyl, 45% propionyl) using a coating solvent mixture of toluene and 3-pentanone.

Particulate lubricant 5

Tospearl 120® (General Electric-Toshiba Silicone, Ltd.) silicone resin powder of poly(methylsilylsesquioxane) of 2 μm spherical size. A suitable binder for this material is cellulose acetate propionate (2.5% acetyl, 45% propionyl) using a coating solvent of toluene, methanol and cyclopentanone.

Particulate lubricant 6

Tospearl 240® (General Electric-Toshiba Silicone, Ltd.) silicone resin powder the same as Particulate lubricant 5 but having 4 μm spherical size. The same binder and coating solvent were used.

The dye-donor elements with slipping layers were tested from relative force required for passage through a thermal print head in the following manner. The dye side of each dye-donor element strip 1.25 inches (32 mm) wide was placed in contact with the dye image-receiving layer of the dye-receiver element of the same width. The assemblage was fastened in the jaws of a stepper motor driven pulling device. The assemblage was laid on top of a 0.55 inch (14 mm) diameter rubber roller and a TDK thermal Head (No. L-133) was presented with a force of 8.0 pounds (3.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were pulse-heated from 0 up to 8.3 msec to generate an "area test pattern" of given density. The voltage supplied to the print head was approximately 21 v representing approximately 1.5 watts/dot (12 mjoules/dot) for maximum power.

As each "area test pattern" of the given density was being generated, the force required for the pulling-device to draw the assemblage between the print-head and roller was measured using a Himmelstein Corp. 10010 Strain Gauge (10 lb. range) and 6–205 Conditioning Module. The force required at Step 2 (moderate transferred density of approximately 0.3) was recorded as being the most responsive for evaluation purposes. The following results were obtained:

TABLE 1

| Particulate Lubricant ($g/m^2$) | Binder ($g/m^2$) | Relative Force (lbs) Step 2 (D = 0.3) |
|---|---|---|
| 1 (0.34)* | c. nitrate* | 1.4 |
| 2 (0.27) | c. acet. buty. (0.27) | 1.3 |
| 2 (0.27) | c. acet. prop. (0.27) | 1.9 |
| 2 (0.27) | c. acet. prop. (0.11) | 1.4 |
| 2 (0.27) | c. acet. prop. (0.05) | 1.9 |
| 2 (0.27) | c. nitrate (0.16) | 1.3 |
| 3 (0.27) | c. nitrate (0.16) | 1.5 |
| 4 (0.54) | c. acet. prop. (0.27) | 1.2 |
| 5 (0.32) | c. acet. prop. (0.54) | ** |
| 6 (0.32) | c. acet. prop. (0.54) | ** |
| None (control 1) | c. acet. prop. (0.54) | tore |
| None (control 2) | c. acet. prop. (0.27) | >8.4 |
| Control 3*** | none | *** |
| Control 4** | c. acet. buty. (0.27) | 3.5 |

*As described above, the cellulose nitrate is an integral part of the commercial material; the coverage of 0.34 $g/m^2$ is particulate lubricant and binder.
**Force was not determined, but passage through the thermal head was smooth and without abrasive noise.
***In a separate preliminary experiment, MS-122 ® Release Agent-Dry Lubricant (Miller-Stevenson Chem. Co.) was sprayed from a pressurized can onto the reverse side of the dye-donor. Upon drying, it was found that these particles had insufficient adhesion and the coating was valueless for further testing as a slipping layer.
****This particulate matter was Cab-O-Sil MS ® (Cabot Corp.), a hydrated silica oxide (0.05 $g/m^2$), 0.01 μm particle size, a material without lubricating properties.

The above data show that the slipping layer composition of the invention minimizes the force required for passage through the thermal head in comparison to various control materials.

Example 2—Comparison with Slipping Layer with Surfactant

This example illustrates the dye transfer problem when a surfactant is present in the slipping layer as taught by EP No. 138,483.

Dye-receivers were prepared as in Example 1. Dye-donors were prepared as in Example 1 with the addition of sorbitan trioleate (STO) and/or silicone surfactant Silwet L-7500 ® (Union Carbide) (SLW). All of these coatings used cellulose acetate propionate (0.27 $g/m^2$) as a binder except for slipping layer 1 of the invention which used cellulose nitrate.

The elements were evaluated for relative force for passage through the thermal print head as described in Example 1. In addition, in a series of separate experiments (not involving the dye-receiver), the dye-donor was multi-wrapped about itself on a one-inch diameter roller and incubated for 4.5 days, 60° C., 50%RH. After this time, the Status A transmission red density was read in areas where no cyan dye was initially coated on the dye-donor side, in order to determine the relative amount of cyan dye transferred to the reverse (slipping) layer side. The following results were obtained:

TABLE 2

| Particulate Lubricant ($g/m^2$) | STO ($mg/m^2$) | SLW ($mg/m^2$) | Rel. Force (lbs) Step 2 | Transfer Dye Density |
|---|---|---|---|---|
| 2 (0.27) | (none - slipping layer 2 of invention) | | 1.9 | 0.10 |

TABLE 2-continued

| Particulate Lubricant ($g/m^2$) | STO ($mg/m^2$) | SLW ($mg/m^2$) | Rel. Force (lbs) Step 2 | Transfer Dye Density |
|---|---|---|---|---|
| 2 (0.27) | 2.7 | 13 | 1.7 | 0.13 |
| 2 (0.27) | 2.7 | 27 | 1.6 | 0.17 |
| (none) | 2.7 | 13 | 2.6 | 0.24 |
| (none) | 2.7 | 27 | 3.9 | 0.22 |
| 1 (0.34) | (none - slipping layer 1 of invention) | | 1.4 | 0.07 |
| 1 (0.34) | 3.4 | 17 | 1.4 | 0.09 |
| 1 (0.34) | 3.4 | 34 | 1.3 | 0.21 |
| Control 4 (0.054) | (none - comparison) | | 3.5 | 0.10 |
| Control 4 (0.054) | 2.7 | 27 | 2.8 | 0.13 |

The above results show that use of a lubricating particulate matter in a binder functions less effectively as a slipping layer when a "waxy" component such as sorbitan trioleate or a silicone surfactant are present. Although the presence of a small quantity of the "waxy" material or surfactant may aid or have no effect upon the force required for passage through a thermal print head, there is an increase in the amount of dye transferred from the dye side (front) to the slipping (back) side of the dye-donor. Use of the slipping layer of the invention minimizes this problem.

Example 3

A multicolor dye-donor was prepared by gravure coating on a 6 μm poly(ethylene terephthalate) support:

(1) a subbing layer of a titanium alkoxide (duPont Tyzor TBT ®) (0.12 $g/m^2$) from a n-propyl acetate and n-butyl alcohol solvent mixture, and (2) a dye layer containing the cyan dye illustrated above (0.42 $g/m^2$) and duPont DLX-6000 Teflon ® micropowder (0.016 $g/m^2$), in a cellulose acetate propionate (2.5% acetyl, 45% propionyl) binder (0.66 $g/m^2$) coated from a toluene, methanol and cyclopentanone solvent mixture.

In a similar manner, repeating alternating areas were coated of the yellow dye illustrated above at (0.21 $g/m^2$) and a binder coverage of 0.37 $g/m^2$, and the magenta dye illustrated above at (0.22 $g/m^2$) and a binder coverage of 0.47 $g/m^2$.

On the back side of the dye-donor was coated a subbing layer of a titanium alkoxide (duPont Tyzor TBT ®) (0.12 $g/m^2$) from a n-propyl acetate and n-butyl alcohol solvent mixture, and a slipping layer using the particulate lubricants as described below.

Particulate lubricant 1

See Example 1

Particulate lubricant 3

See Example 1

The following control lubricants are based upon the examples in JP No. 60/192,630.

Control 5

Fluon AD-1 ® (ICI Corp.) aqueous polytetrafluoroethylene dispersion of 0.2 μm average particle size.

Control 6

Teflon 30 ® (duPont Corp.) aqueous polytetrafluoroethylene dispersion of 0.05–0.5 μm average particle size.

A dye-receiving element was prepared by coating the following layers in the order recited on a titanium dioxide-pigmented polyethylene-overcoated paper stock which was subbed with a layer of poly(acrylonitrile-co-vinylidene chloride-co-acrylic acid) (14:79:7 wt. ratio) (0.08 g/m$^2$) coated from 2-butanone:

(1) Dye-receiving layer of Makrolon 5705® (Bayer AG Corporation) polycarbonate resin (2.9 g/m$^2$), Tone PCL-300® polycaprolactone (Union Carbide) (0.38 g/m$^2$), and 1,4-didecoxy-2,6-dimethoxyphenol (0.38 g/m$^2$) coated from methylene chloride; and (2) Overcoat layer of Tone PCL-300® polycaprolactone (Union Carbide) (0.11 g/m$^2$), FC-431® surfactant (3M Corp.) (0.011 g/m$^2$) and DC-510® Surfactant (Dow Corning) (0.011 g/m$^2$) coated from methylene chloride.

The dye side of the dye-donor element strip approximately 10 cm×13 cm in area was placed in contact with the dye image-receiving layer of the dye-receiver element of the same area. The assemblage was clamped to a stepper-motor driven 60 mm diameter rubber roller and a TDK Thermal Head (No. L-231) (thermostatted at 26° C. ) was pressed with a force of 8.0 pounds (3.6 kg) against the dye-donor element side of the assemblage pushing it against the rubber roller.

The imaging electronics were activated causing the donor-receiver assemblage to be drawn between the printing head and roller at 6.9 mm/sec. Coincidentally, the resistive elements in the thermal print head were pulsed for 29 μsec/pulse at 128 μsec intervals during the 33 msec/dot printing time. A stepped density image was generated by incrementally increasing the number of pulses/dot from 0 to 255. The voltage supplied to the print head was approximately 23.5 volts, resulting in an instantaneously peak power of 1.3 watts/dot and a maximum total energy of 9.6 mjoules/dot.

The cyan, magenta and yellow dye-donors were sequentially registered on the dye-receiver to obtain a multicolor image.

As each "area test pattern" of the given density was being generated, the force required for the pulling-device to draw the assemblage between the print-head and roller was measured using a Himmelstein Corp. 3-08TL Torquemeter (10 inch-lb) and 6-205 Conditioning Module. The force required at Step 2 (moderate transferred density of approximately 0.3) was recorded as being the most responsive for evaluation purposes. The following results were obtained:

TABLE 3

| Particulate Lubricant (g/m$^2$) | Binder* (g/m$^2$) | No. of Smile Defects | Relative Force (lbs) Step 2 (D = 0.3) |
|---|---|---|---|
| 1 (0.22) | CN (0.23) | None | 1.2 |
| 1 (0.18) | CN (0.18) | None | 1.0 |
| 3 (0.14) | CN (0.22) + Butvar 76 ® (0.01) | None | 3.2 |
| 3 (0.14) | CAP (0.22) + Butvar 76 ® (0.01) | None | 2.5 |
| Control 5 (0.14) | A (0.22) | 7 | 4.0 |
| Control 5 (0.37) | B (0.09) | >10 | 3.4 |
| Control 5 (0.14) | B (0.22) | >10 | 4.8 |
| Control 5 (0.14) | C (0.22) | ** | — |
| Control 5 (0.14) | D (0.22) | >10 | 3.5 |
| Control 6 (0.37) | B (0.09) | >10 | 2.7 |
| Control 6 (0.14) | B (0.22) | >10 | 3.2 |

*CN = Cellulose nitrate
CAP = Cellulose acetate propionate (2.5% acetyl, 45% propionyl)

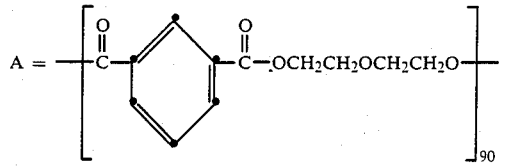

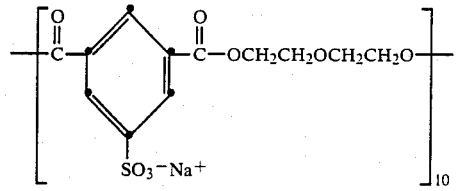

A copolymer of partially sulfonated poly(diethyleneglycol isophthalate).

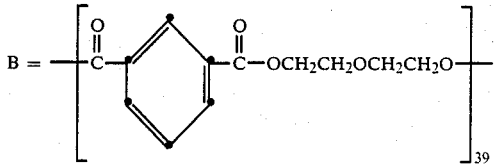

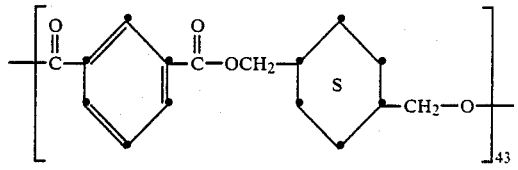

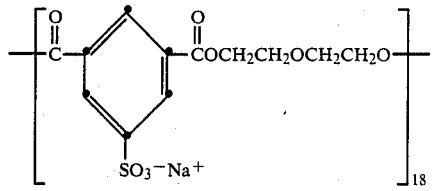

A copolymer of partially sulfonated poly(diethyleneglycol isophthalate) modified with cyclohexanedimethanol isophthalate.

C=an aqueous polyurethane dispersion of the reaction product of 1,6-hexane diisocyanate caprolactone, and sodium aminoethanesulfonate (5:3:2 mole ratio)

D=Poly(n-butyl acrylate-co-2-acrylamido-2-methylpropane sulfonic acid, sodium salt) (97:3 weight ratio)

**No printing possible

The above results show that less force is required for passage through the printing head and fewer printing defects are obtained with the slipping layer of the invention in comparison to the control slipping layers which are aqueous dispersions.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having on one side thereof a dye layer and on the other side a slipping layer comprising a lubricating material dispersed in a binder having as its majority component a water-insoluble, cellulosic material, said lubricating material comprising dry, solid lubricant particles protruding from the surface of said slipping layer.

2. The element of claim 1 wherein said cellulosic binder also contains a polyvinyl acetal.

3. The element of claim 2 wherein said polyvinyl acetal is a terpolymer of polyvinyl butyral, polyvinyl alcohol and polyvinyl acetate.

4. The element of claim 1 wherein the ratio of binder to lubricant is from about 0.1 to about 10.

5. The element of claim 1 wherein said lubricant particles are poly(tetrafluoroethylene), poly(hexafluoropropylene) or poly(methylsilylsesquioxane).

6. The element of claim 1 wherein said lubricant particles have an average particle size below about 10 μm.

7. The element of claim 1 wherein said water-insoluble, cellulosic binder is cellulose nitrate.

8. The element of claim 7 wherein said cellulose nitrate binder also contains a terpolymer of polyvinyl butyral, polyvinyl alcohol and polyvinyl acetate.

9. The element of claim 8 wherein said dye layer comprises sequential repeating areas of cyan, magenta and yellow dye.

10. A process of forming a dye transfer image comprising (a) imagewise-heating a dye-donor element comprising a support having on one side thereof a dye layer and on the other side a slipping layer comprising a lubricating material dispersed in a binder having as its majority component a water-insoluble, cellulosic material, and (b) transferring a dye image to a dye-receiving element to form said dye transfer image, said lubricating material comprising dry, solid lubricant particles protruding from the surface of said slipping layer.

11. The process of claim 10 wherein said cellulosic binder also contains a polyvinyl acetal and the ratio of binder to lubricant is from about 0.1 to about 10.

12. The process of claim 10 wherein said lubricant particles are poly(tetrafluoroethylene), poly(hexafluoropropylene) or poly(methylsilylsesquioxane).

13. The process of claim 10 wherein said lubricant particles have an average particle size below about 10 μm.

14. The process of claim 10 wherein the support of said dye-donor element is poly(ethylene terephthalate) which is coated with sequential repeating areas of cyan, magenta and yellow dye, and said process steps are sequentially performed for each color to obtain a three-color dye transfer image.

15. A thermal dye transfer assemblage comprising:

(a) a dye-donor element comprising a support having on one side thereof a dye layer and on the other side a slipping layer comprising a lubricating material dispersed in a binder having as its majority component a water-insoluble, cellulosic material, and (b) a dye-receiving element comprising a support having thereon a dye image-receiving layer, said dye-receiving element being in a superposed relationship with said dye-donor element so that said dye layer is in contact with said dye image-receiving layer, said lubricating material comprising dry, solid lubricant particles protruding from the surface of said slipping layer.

16. The assemblage of claim 15 wherein said cellulosic binder also contains a polyvinyl acetate.

17. The assemblage of claim 16 wherein said polyvinyl acetal is a terpolymer of polyvinyl butyral, polyvinyl alcohol and polyvinyl acetate.

18. The assemblage of claim 15 wherein the ratio of binder to lubricant is from about 0.1 to about 10.

19. The assemblage of claim 15 wherein said lubricant particles are poly(tetrafluoroethylene), poly(hexafluoropropylene) or poly(methylsilylsesquioxane), having an average particle size below about 10 μm.

20. The assemblage of claim 15 wherein the support of said dye-donor element comprises poly(ethylene terephthalate) and said dye layer comprises sequential repeating areas of cyan, magenta and yellow dye.

* * * * *